United States Patent [19]

Prichard, Jr.

[11] 4,220,239

[45] Sep. 2, 1980

[54] TRANSFER AND INVERTER MACHINE

[75] Inventor: Guy Prichard, Jr., Enterprise, Kans.

[73] Assignee: Combustion Engineering, Inc., Windsor, Conn.

[21] Appl. No.: 928,642

[22] Filed: Jul. 27, 1978

[51] Int. Cl.[2] ..... B65G 47/24

[52] U.S. Cl. ..... 198/403; 414/760; 414/762

[58] Field of Search ..... 198/403; 414/758, 759, 414/760, 761, 762, 763

[56] References Cited

U.S. PATENT DOCUMENTS

| | | | |
|---|---|---|---|
| 2,527,024 | 10/1950 | Mitchell | 198/403 |
| 3,247,963 | 4/1966 | Fehely | 198/403 X |
| 3,380,570 | 4/1968 | Jordan | 198/403 |

*Primary Examiner*—Robert W. Saifer
*Assistant Examiner*—Douglas D. Watts
*Attorney, Agent, or Firm*—Arthur L. Wade

[57] ABSTRACT

A machine is positioned in the line of a gypsum board manufacture to provide lifting arms, which are actuated up through the line to remove board sections, invert and transfer them to an adjacent area for subsequent drying. The lifting arms are reciprocated, end for end, during the elevating and inverting action to subsequently approach the board from beneath. The lifting arms are actuated through slider boxes, attached to a shaft, and a cam is provided to control the ends of the lifting arms, as each end is pivoted at the inverter shaft to which its slider box is attached.

4 Claims, 7 Drawing Figures

TRANSFER AND INVERTER MACHINE

BACKGROUND OF THE INVENTION

1. Field of the Invention

The present invention relates to the necessary inversion and transfer of green gypsum board from its line of manufacture to orient it for the drying ovens. More specifically, the present invention relates to a transfer machine in its control of lifting arms, so they will approach the live rolls from beneath, and remove the green board from the live rolls.

2. Prior Art

The green plaster board is formed by sandwiching a hot, wet slurry of gypsum between a cream face paper and a gray backing paper. After being formed, the board is conveyed along a belt for several hundred feet to allow set up of the wet slurry before cutting to length. After the boards are cut to length, they are arranged in groups of 1, 2, 3 or 4, (depending on their individual length) to be inverted so they go through the dryer with the cream face up. They are grouped by means of an accelerating section of the conveyor belt. The accelerating section pulls gaps between the groups to allow time for them to be inverted. After being inverted, the boards are transferred onto a tipple table, which feeds a multi-decked dryer.

Present inverting and transferring machines are positioned near the live rolls section of the conveyor system, on which the boards to be inverted come to rest. A series of arms have previously been pivoted down into position beneath the plane of the live rolls. After the board has come to rest on the live rolls, with the inverter arms below their plane, the arms have been pivoted by an inverter shaft at right angle to the live rolls and the boards are elevated, inverted and caught by a second group of arms, which lower the boards, inverted, to be made up into the groups for drying.

It is obvious that in the prior art system, inverting arms must be positioned below the live rolls prior to the approach of the board. Time must be allocated for the lifting arms to be pivoted back into position before the next board to be inverted can come onto the live rolls. This is a lost segment of time. If the lifting arms can be consistenly raised from beneath, rather than being lowered from above, the boards can be more or less continuously flowed to their elevating position.

Additionally, if the lifting and transfer machine can be arranged to consistantly raise the lifting arms from beneath the live rolls, there is the possibility that the space required to accommodate the machine in the line of manufacture could be reduced. Therefore, there are two possibilities for improving green board transfer and inversion. In the first instance, time can be saved if the lifting arms are properly manipulated. Secondly, the space required for the machine could be reduced.

SUMMARY OF THE INVENTION

The present invention contemplates an inverter shaft at right angles to live rolls on which are received green board to be inverted and transferred. The inverter shaft has a series of slider boxes attached to it. An elongated lifting arm structure is positioned in each slider box and reciprocated therein. A cam structure is positioned beneath each slider box and the live rolls to receive, retain and guide the ends of the lifting arm. As the inverter shaft rotates, the slider box forces its lifter arm to pivot up through the line of lifting rolls. The end of the lifting arm at the slider box is received by, and controlled by, the lower cam structure to begin pulling the lifting arm down through the slider box, after the lifting arm has delivered the inverting green board to a catcher arm. Continued rotation of the inverter shaft forces the cam-caught end of the lifting arm to be pulled up and toward the live rolls from beneath. Therefore, the opposite side of the lifting arms are brought upward to contact a new green board needed to be elevated, inverted and transferred.

The cycle of alternate ends of the lifting arms engaging the cam structure and being guided through the rotated slider box alternately brings the two faces of the lifting arm into alternate engagements with the train of green boards sequentially arriving at the live roll position.

Other objects, advantages and features of the invention will become apparent to one skilled in the art upon consideration of the written specifications, appended claims, and accompanying drawings.

DESCRIPTION OF THE PREFERRED EMBODIMENT

Figure 1:
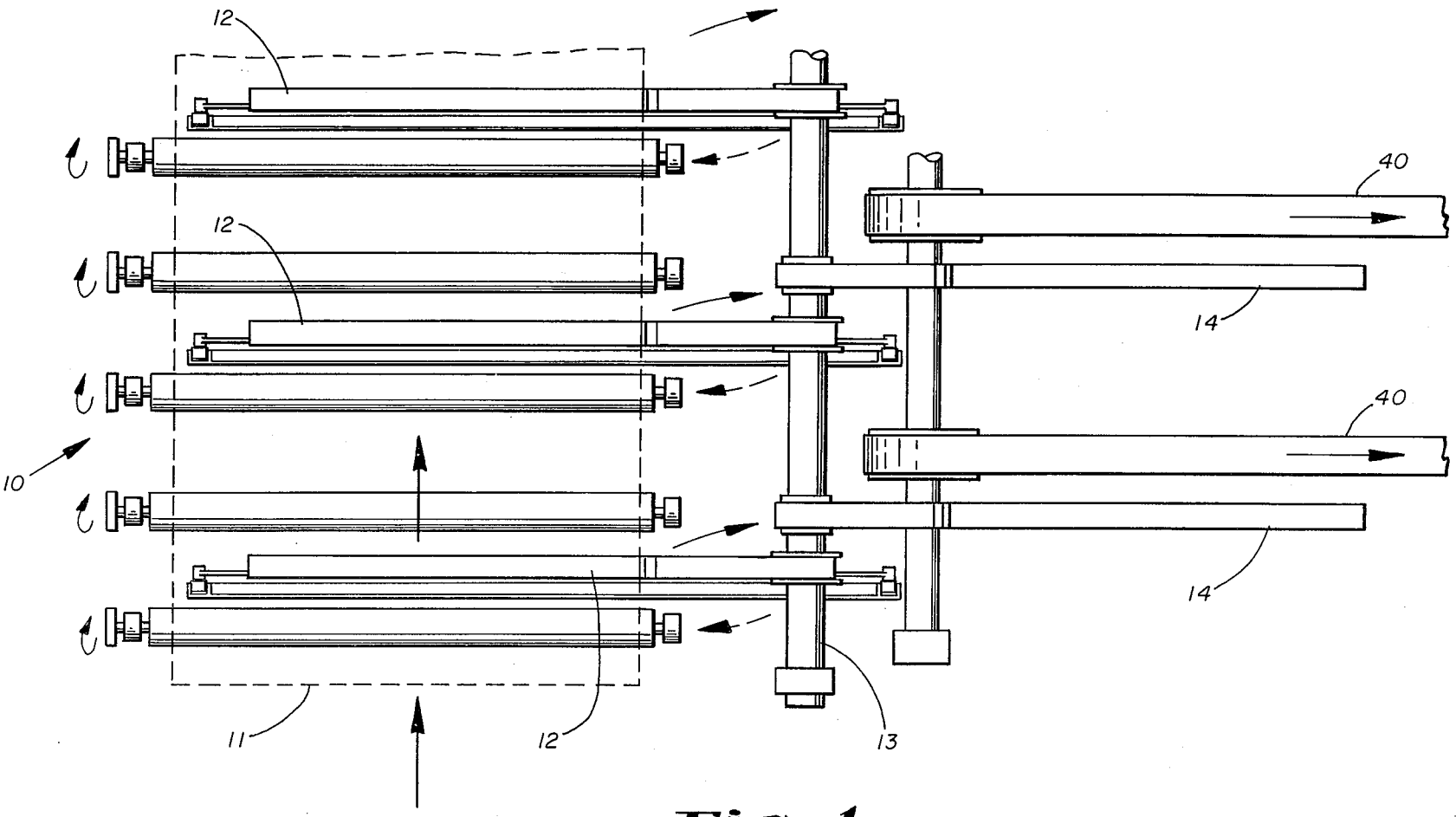
FIG. 1 is a plan view of the live rolls of a conveyor system and transfer system at the live rolls, in which the present invention is embodied.

FIG. 1 shows a set of live rolls 10, which form a platform in a conveyor system, to which thin, sheet-like material is brought to rest. In this preferred embodiment, this sheet-like material will be described as wallboard, or gypsum board, which has been conveyed to the live rolls after its initial formation. The pre-cut sections of this board 11 have emerged from the manufacturing process, and have been given their initial set up by cooling. The must be transferred to an oven to complete their curing into the final product. Therefore, these boards must be elevated from their conveyor line, inverted for oven drying and transferred to an area adjacent the live roll platform 10.

Prior to the present invention, multiple lifting arms have been pivoted down into positions below the plane of the live rolls. The highly frangible wet boards have been elevated by the pivoted arms and flopped over to be caught on catcher arms, which then tenderly lower them to the adjacent area for transfer into an oven. In the prior art, the lifting arms were simply pivoted back down between the live rolls from above, so the next board could be brought into position over the arms for the next lift. In contrast, the present invention shuttles each lifting arm into position beneath the live rolls to avoid being pivoted into their lift position from above the live rolls.

In FIG. 1, lifting arms 12 are generally depicted as actuated from one end by inverter shaft 13. The means for rotating both the live rolls 10 and inverter shaft 13 is not disclosed in detail. Obviously, a motor is connected to the rolls and shaft by belts or gears to rotate them. Also, the control system for limiting and reversing the rotation of these rolls and shafts, as needed, is necessary to overall operation. However, the control system and its motor need not be set forth specifically to disclose the present invention.

As inverter shaft 13 rotates clock-wide, away from the upper surface of the board, it pivots lifting arms 12 upward to elevate a green wallboard from the plane of the live rolls. At the same time, catcher arms 14 are also pivoted from shaft 13 up to that position where they will gently receive the delicate wallboard and ease it down upon a second conveyor system, which sends it on its way to the drying holocaust of ovens.

In FIG. 1, the prior art problem of manipulating the lifting arms can be inferred, as well as the solution provided by the present invention.

Obviously, if the prior art lifting arms need not be pivoted from their elevated position back down through the plane of the live rolls, time for the arrival of the boards to be elevated can be shortened. The present invention solves this problem by shuttling the lifting arms at their inverter shaft 13, end-for-end, and sneaking them up under the plane of the live rolls. How this accomplished, will become evident by inspection of subsequent figures.

Figure 2:
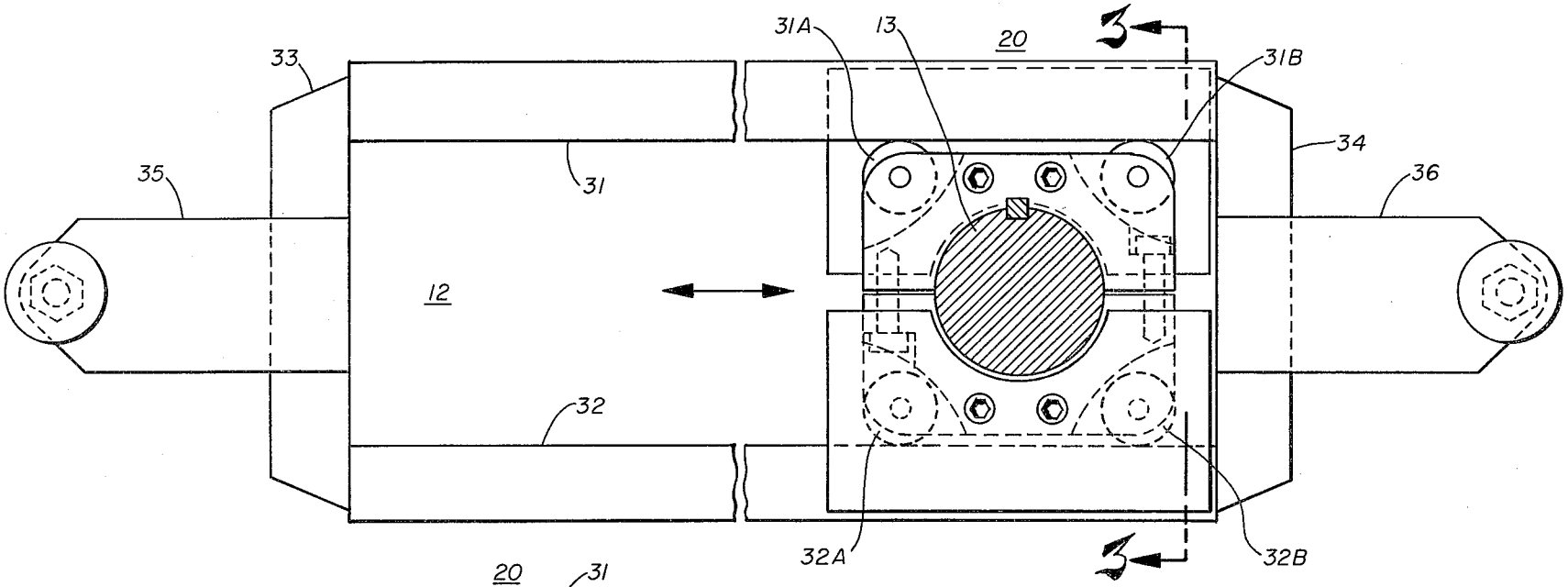
FIG. 2 is a sectioned elevation at slider boxes mounted on the inverter shaft, with its lifting arm at one of its two extreme positions.

FIG. 2 provides the critical analyses of cooperation between slider box 20 keyed to inverter shaft 13. In general, slider box 20 is a framework, which is firmly fixed to shaft 13 to provide support, manipulation and rolling contact with its lifting arm 12.

Now it can be seen that each lifting arm 12 is essentially two parallel beams 31 and 32, held in their relation to each other by end beams 33 and 34. Each of these beams, 31 and 32, engage slider box 20 through a set of rollers. As can be discerned readily in FIG. 2, roller 31-A roller 31-B on slider box 20 directly contact beam 31. In similar fashion, roller 32-A and 32-B, on the other side of slider box 20, directly contact beam 32.

Again, in FIG. 2, it can be clearly discerned that lifting arm 12 is shown in one of its two extreme positions relative to slider box 20. As viewed in FIG. 2, lifting arm 12 is moved to its extreme lifting range of movement. The lifting arm 12 can readily slide to the right until slider box 20 limits its movement.

At each end of lifting arm 12 is a cam-engaging arm, with which sliding force can be applied to move the arm relative to slider box 20. More specifically, cam-engaging arm 35 is on one end of the lifting arm 12, and cam-engaging arm 36 is on the other end of lifting arm 12. Each of these cam-engaging arms is equipped with rolling devices to specifically contact a cam, which will conrol the reciprocation of the lifting arm in slider box 20.

Figure 3:
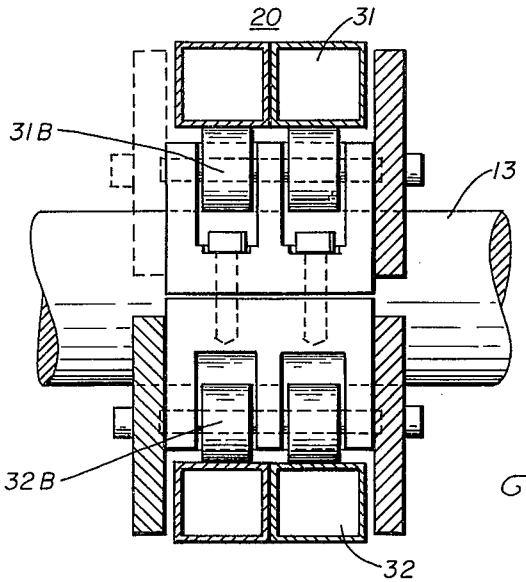
FIG. 3 is a section of FIG. 2, along lines 2—2.

FIG. 3 is a sectioned elevation of FIG. 2 to expand the understanding of how the two beam lifting arms 12 rides on the rollers of the slider box 20 to maintain rolling contact between the arm and inverter shaft 13, carrying out the objects of the invention.

FIGS. 4–7 now disclose how all of the embodying structures come together and cooperate to delicately pluck green boards from live rolls 10, and deposite them as delicately as a mother's kiss upon adjacent conveyor 40. This ancient and honorable result is now achieved with astounding simplicity by the implementation of the concepts of the present invention.

FIGS. 4–7 give us a sequence of this cooperation of structure with clarity that rivals that of a motion picture.

Now the live rolls 10, inverter shaft 13 and catcher arms are shown in elevation. The manner in which the catcher arms are manipulated is essentially the same as in the prior art. Therefore, little drawing disclosure is devoted to actuation of these arms. It is sufficient to disclose how the catcher arms 14 are brought, pivoting, upward to receive the transfer board from the lifting arms of the invention.

The FIGS. 4–7 give us little view of the live rolls, actually, the first of the live rolls is not shown to give full disclosure to the first of the lifting arms 12, as it is controlled by its slider box on shaft 13.

Figure 4:
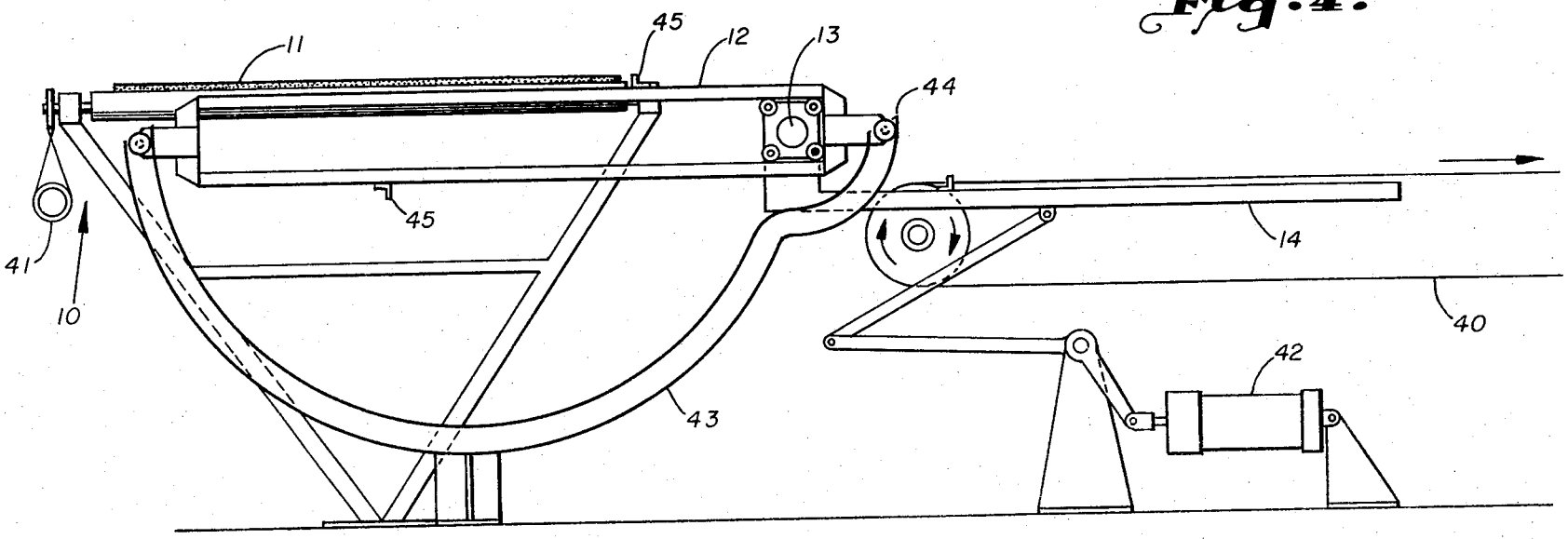
FIGS. 4–7 show, in sequence, the cycle of lifting arm 12 actuation, to elevate, invert and transfer green gypsum board.

FIG. 4 shows lifting arms 12 horizontally disposed just below the board 11. Catcher arms 14 are also horizontal beneath the surface of conveyor 40, upon which the inverted board 11 is placed. Actuation of live rolls 10 is indicated by motor 41. Motive means for inverter shaft 13 is not shown as it would unnecessarily clutter the drawings and obscure understanding of the information. Hydraulic cylinder 42 is disclosed as linked to arms 14 to raise and lower the catching arms pivoted from shaft 13. Thus, FIG. 4 is a good place to begin the cycle of operation.

The disclosure is dominated by cam structure 43. Each of the slider boxes and their lifting arms attached to shaft 13 has a cam 43 mounted beneath them. Cam 43 is a retaining tract, which receives the ends of its lifting arm 12 at 44. As inverter shaft 13 rotates clockwise, slider box 20 forms a link between the shaft and its lifting arm 12 to pivot the lifting arm from its right hand end as disclosed in FIG. 4.

The cam is shaped to cooperate with the end of the lifting arm to the end that the lifting arm is first pivoted about the axis of shaft 13, and then drawn down through box 20, until the opposite end of shaft 13 is engaged with a cam at point 44. This progressive actuation of the lifting arm can be followed through the four simple FIGS. 4–7.

Figure 5:
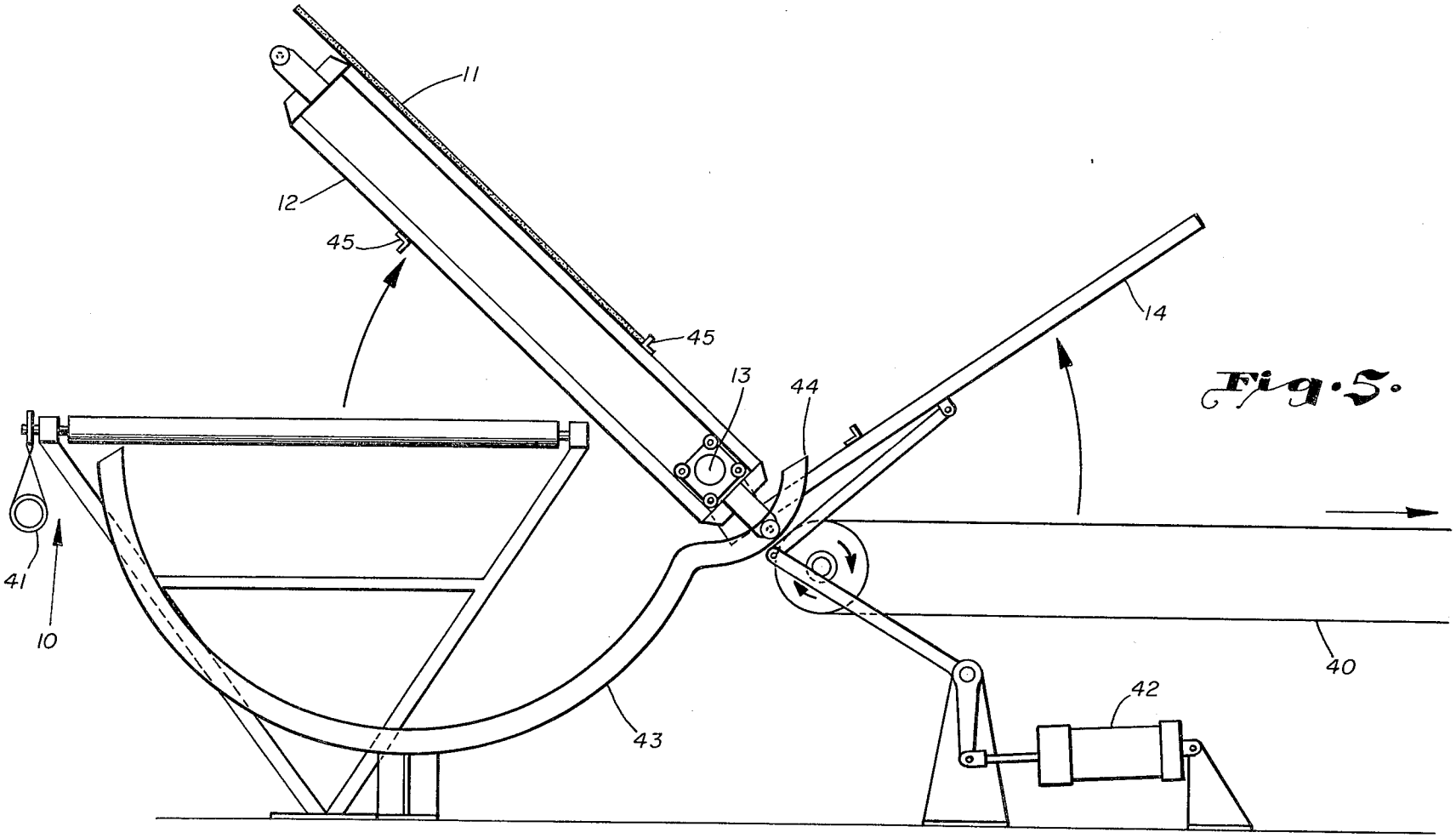

FIG. 5 discloses the lifting arm pivoting through an angle, which elevates the board from the plane of the live rolls, while the catcher arms 14 begin their pivoting upward to receive the board. Incidentally, the board is held on a bracket 45, so it will not slip down the length of the lifting arm.

Figure 6:
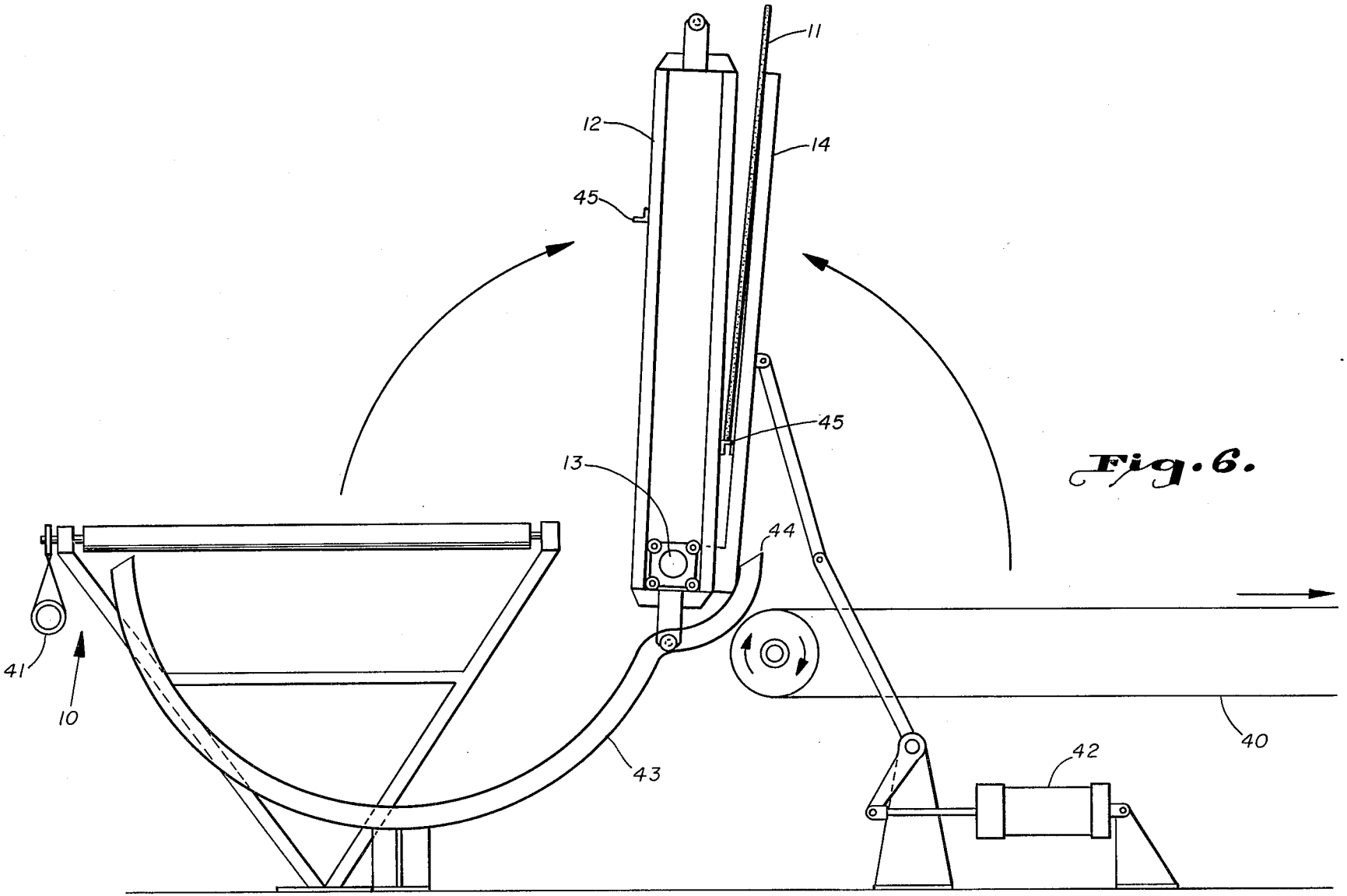

FIG. 6 shows the meeting of the lifting and receiving arms at the top of the arcs, through which they pivot. Of course, the timing and spacing and travel of these structures must be precise, in order to gently throw the board from the lifting arms to the catching arms. It is not within the scope of this disclosure to further dwell on these practical, important problems of adjustment.

The inventive concept is dramatically embodied in the control of lifting arms exerted by cam 43. FIG. 6 shows the first part of cam 43 bringing the lifting arms up to the transfer position. Essentially, this much has been done in the prior art. Now we go down on the other side of the hill with inventive concept.

Figure 7:
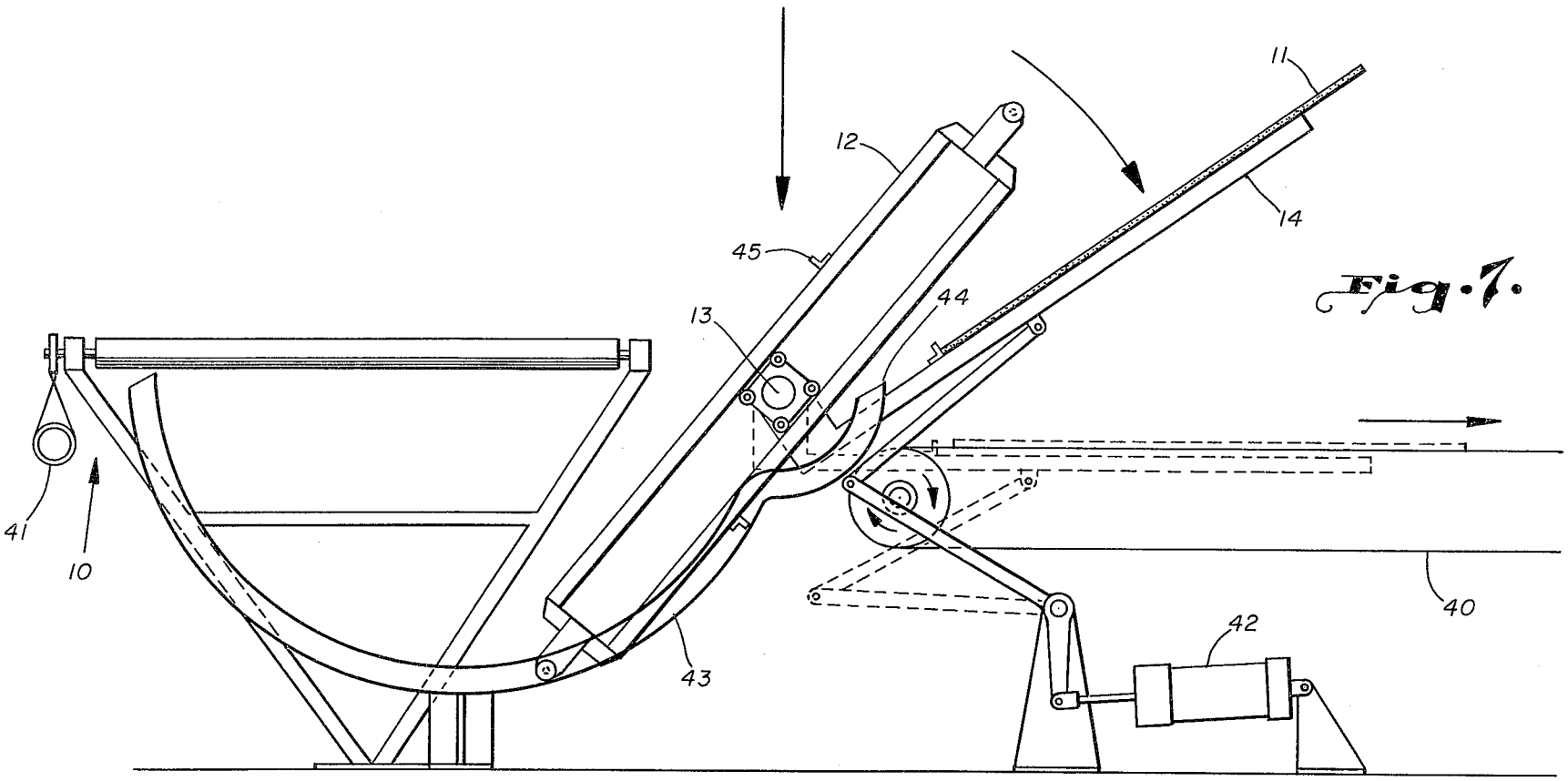

FIG. 7 shows how the lifting arm 12 is carried down through the slider box by the lower end of the lifting arm, being pulled in a downward arc of the cam 43. At this point in the cycle, the catcher arms 14 have begun to lower their precious cargo toward the conveyor belt 40, while the lifting arm 12 begins its descent into the depths beneath the plane of the live rolls. While it may be said that beam 31 of arm 12 has lifted the first board and inverted it into the catcher arms, cam 43 has now directed the entire assembly of the lifting arm beneath the live rolls, and is ready to move the opposite side, i.e.

32, into position to elevate and invert the subsequent board on the live rolls.

Back we go to FIG. 4, only now, the lifting arm has been turned over. Again, the lifting arm is pivoted, only now from its end opposite that shown in FIG. 4. It would be useless and deadly to repeatedly describe this cycle.

It should now be glaringly apparent that the invention formulates an entirely new form and action for lifting arms to elevate and invert delicate thin, sheet-like forms of material. Specifically, green boards, hot off the assembly line, are handled with aplomb, sent on their way to ovens, which impart to them sturdiness derived from oven drying.

A continuous train of these articles are fed onto the platform of live rolls and flipped therefrom, like flapjacks, into the tempering ovens that await them. It is clear that a notable advance has been made in this art of material handling and transfer of the reduction in force base and time, when compared with the prior art.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

This invention having been disclosed, what is claimed is:

1. A machine with which to invert a body with a thin flat configuration including, a set of live rolls arranged in parallel and in a single plane on which rests a thin flat body requiring inversion, an inverter shaft extending at a right angle to the set of live rolls and spaced from one end of the live rolls, a series of slider boxes spaced along the shaft opposite selected spaces between the live rolls and keyed to the shaft at these positions to turn with the shaft, a lifting arm extended through each slider box wherein each lifting arm includes two beams held in parallel by end pieces to engage its box through rollers mounted in the box and arranged to reciprocate end for end through its slider box as the boxes are rotated with the shaft, a series of cams extending and arranged beneath the live rolls and inverter shaft with the arrangement for each cam to alternately receive the ends of the lifting arms as the inverter shaft rotates and guide and control its arm in its reciprocation through the slider box with the result that the lifting arms pivot at the inverter shaft to elevate the thin flat body from the live rolls and transfer it to a station laterally adjacent the live rolls, and a set of receiving arms positioned to receive the thin flat body and lover it to the transfer station.

2. The machine of claim 1 wherein:

each cam is shaped to maintain a constant relation between the end of its lifting arm and the inverter shaft as the lifting arm is pivoted through the arc, which will invert the flat body and then slide the lifting 3. The machine of claim 1, wherein:

the receiving arms are pivoted from the inverter shaft by means of linkage with a hydraulic cylinder which pivots the receiving arms to meet the lifting arms and receive the inverted body and then lower the received body to a conveyor system.

4. An inverting machine for flat sheets or relatively thin material, including, a flat sheet of relatively thin material positioned in a first horizontal plane, a shaft extended in a first horizontal plane adjacent the flat sheet, means for rotating the shaft in a direction away from the upper surface of the flat sheet, at least one slider box fixed on the shaft to rotate therewith, an elongated arm journaled through the slider box and engaging the slider box through rollers mounted in the slider box to reciprocate end for end in the slider box as the shaft is rotated, a cam structure fixed beneath the first horizontal plane and shaped and arranged to alternately receive the ends of the elongated arm as each end extends from its slider box to cause the lifting arm to pivot from the shaft through a pre-determined angle and subsequently slide through its box and bring its alternate end into engagement with the cam structure and repeat the cycle as the shaft rotates, and a catcher arm pivoted from the shaft through an angle complimental to the angle through which the lifting arm pivots to receive the flat sheet and deliver it to a second horizontal plane laterally removed from the first horizontal plane, wherein the sheet of material is elevated by the lifting arm through the pre-determined angle and at least one catcher arm is pivoted at the shaft from the second horizontal plane through the angle complemental to the pre-determined angle of the lifting arm to receive the inverted sheet of material and subsequently lower it to the second horizontal plane.

* * * * *